US005941002A

United States Patent [19]

Rusin

[11] Patent Number: 5,941,002

[45] Date of Patent: Aug. 24, 1999

[54] STADIUM SIGNAGE SYSTEM AND METHOD

[76] Inventor: Clifford R. Rusin, 267 Calumet Ave., Lowell, Ind. 46356

[21] Appl. No.: 08/825,892

[22] Filed: Apr. 2, 1997

[51] Int. Cl.[6] ..... G09F 7/18

[52] U.S. Cl. ..... 40/606; 40/605

[58] Field of Search ..... 40/606, 605, 611; 160/351, 135

[56] References Cited

U.S. PATENT DOCUMENTS

| | | | |
|---|---|---|---|
| D. 376,821 | 12/1996 | Hathaway . | |
| 1,858,152 | 5/1932 | Hallowell et al. | 40/606 |
| 2,388,435 | 11/1945 | Puerner et al. | 40/764 |
| 3,428,108 | 2/1969 | Singer | 40/605 |
| 3,969,838 | 7/1976 | Moore | 40/606 |
| 4,271,622 | 6/1981 | Tippmann et al. . | |
| 4,492,049 | 1/1985 | Gaylor . | |
| 4,884,351 | 12/1989 | Abramson | 40/606 |
| 5,402,988 | 4/1995 | Eisle . | |
| 5,577,714 | 11/1996 | Venegas, Jr. . | |

*Primary Examiner*—Cassandra H. Davis

*Attorney, Agent, or Firm*—Wallenstein & Wagner, Ltd.

[57] ABSTRACT

A stadium signage system (10) is provided for displaying promotional or informational signs at field events such as soccer games played in a stadium having a grandstand facing a playing field. A support frame (18) is supported in an upright position by a pair of mounting stands (14). The support frame (18) has a bottom rail (26) and a top rail (24) and is positioned between the grandstand and the playing field. A first channel (20) is connected to the bottom rail (26) and has a first upward member (38) confronting a first side (39) of the bottom rail (26) wherein a first space (C1) is defined between the first upward member (38) and the first side (39) of the bottom rail (26). The first channel (20) also has a second upward member (40) confronting a second side (41) of the bottom rail (26) wherein a second space (C2) is defined between the second upward member (40) and the second side (41) of the bottom rail (26). A first adpanel (16) is inserted into the first space (C1) and faces the playing field. A second adpanel (16) is inserted into the second space (C2) and faces the grandstand. A second channel (22) is releasably secured to the top rail (24) and has a first downward member (46) and a second downward member (48). The downward members (46,48) retain top edges of the adpanels (16) against the top rail (24).

25 Claims, 4 Drawing Sheets

STADIUM SIGNAGE SYSTEM AND METHOD

TECHNICAL FIELD

This invention relates generally to a system for displaying promotional and other signage at events, and more particularly concerns a stadium signage system for displaying promotional signage at field events such as soccer games.

BACKGROUND OF THE INVENTION

It is common for stadium owners to display advertising and other signage at sporting events. Many stadiums, such as those for football, hockey, soccer, basketball and baseball, are equipped with a number of different advertising systems including electronic scoreboard displays, rotating signs and traditional billboards. Although popular in other parts of the world for some time, soccer games have become increasingly popular in the U.S. Greater interest has resulted in increased stadium attendance and television coverage. The greater audience has led to increased advertising exposure at soccer games. For example, advertising signs can be placed around the periphery of the playing field and facing the playing field. In this configuration, spectators can view the advertising signs placed on the opposite side of the playing field. In addition, television cameras covering the game include the advertising and promotional signage in the background of the television picture, further increasing the advertising exposure.

Applicant is aware of only one portable signage system being used at soccer games. The system has been used in the U.S. Applicant believes the system is operated by Stadium Publicity, Ltd., an English corporation. This signage system generally includes plywood signs and lightweight metal support stands. Advertisements are painted directly onto the plywood signs, which are approximately ten feet long. Furring strips are attached on the outer edges of the backside of the plywood sign. A narrow wood piece is vertically attached to the furring strips at each end of the sign, thus defining a space between the wood piece and the sign. The support stand is L-shaped and has a vertical portion. To stand the sign upright, the vertical portion of the support stand is inserted into the space between the wood piece and the sign at each end of the sign. Because the support stands are lightweight, sandbags are then placed on base portions of the support stands to add stability to the sign.

There are a number of problems involved with this system. Because the advertisements are painted directly onto the plywood signs, advertisements cannot be easily changed. Painted signs are also inferior in appearance to printed signs. The construction of this system only allows advertisements to face the playing field, or television side. Advertisements do not face the stadium grandstands, or spectator side.

Furthermore, in this signage system, the vertical portion of the support stand is two feet high. This makes it difficult to lift the sign high enough to insert the vertical portion in the space between the narrow wood piece and the plywood sign. In addition, the furring strip leads to a large clearance between the support stands and the sign. Consequently, the sign tends to wobble excessively. Because the support stands are lightweight, sandbags are required to be placed on the support stands to prevent the sign from tipping over. These sandbags are considered unsightly. The sandbags also present a tripping hazard and occupy additional space on the field. If a plurality of signs are placed adjacent one another on end around the periphery of the playing field, there is no direct access to the field. To provide direct access, an entire sign assembly must be inconveniently lifted and moved out of the way. Finally, this system requires a great amount of time to set-up and is difficult to store and transport from stadium to stadium.

The present invention is provided to solve these and other problems.

SUMMARY OF THE INVENTION

The present invention relates to a stadium signage system for displaying promotional signage at field events such as soccer games. The system could also be used at other events where promotional or other informational signage is desired. According to a first aspect of the invention, a support frame is supported in an upright position by a mounting stand. In a preferred embodiment, a pair of mounting stands is used. The support frame has a bottom rail and a top rail. The support frame has a receiving member having a first space therein for receiving a display panel, sometimes referred to as an adpanel. In a preferred embodiment, the receiving member is a first channel. The first channel extends along the bottom rail and has a first upward member. The first space is defined between the first upward member and a first side of the bottom rail. An adpanel having a promotional sign thereon is inserted into the first space. The promotional sign is supported adjacent the support frame and the promotional sign can be viewed by event spectators. The adpanel can have a promotional sign on a backside of the panel, opposite the first promotional sign. Promotional signs can, therefore, be viewed from both sides of the support frame. A second channel can be provided that is releasably secured to the top rail. The second channel has a downward member that retains a top edge of the adpanel against the top rail of the support frame.

According to a further aspect of the invention, the first channel has a second upward member wherein a second space is defined between the second upward member and a second side of the bottom rail. A second adpanel having a promotional sign thereon is inserted into the second space wherein the second adpanel is positioned adjacent an opposite side of the support frame with the promotional sign on the second adpanel facing away from the support frame for viewing by event spectators. The second channel provided also has a second downward member that retains a top edge of the second adpanel against the top rail. In a preferred embodiment, the signage system is positioned between a stadium grandstand and a playing field. Because the support frame can accommodate adpanels on both sides, signage can face both the playing field, or television side, and the stadium grandstand, or spectator side. In addition, because the adpanels themselves can have promotional signs on each side of the adpanel and the adpanels can face different sides of the support frame, the signage system provides a number of options for displaying different signage. The system, therefore, provides great flexibility.

According to another aspect of the invention, a plurality of signage systems are placed adjacent to one another on end around a periphery of a playing field.

According to another aspect to the invention, a modified mounting stand can be used at certain locations to connect a first signage system to a second signage system. The modified mounting stand rotatably supports the second signage system allowing the second signage system to function as a gate. This configuration allows direct and easy access to and from the playing field. Typically, three modified mounting stands are used to provide for three gates around the field.

According to a further aspect of the invention, tight clearances are provided between the mounting stands and support frame and between the adpanels and channels. In addition, the adpanels are constructed from an aluminum/polycarbonate composite. The mounting stands have an elongated base and are weighted. Accordingly, a rigid, stable, strong signage system is provided that is quickly set-up and disassembled. Furthermore, the signage system is portable and easily transported from stadium to stadium.

Other features and advantages of the invention will be apparent from the following specification taken in conjunction with the following drawings.

DETAILED DESCRIPTION OF THE PREFERRED EMBODIMENT

Figure 1:
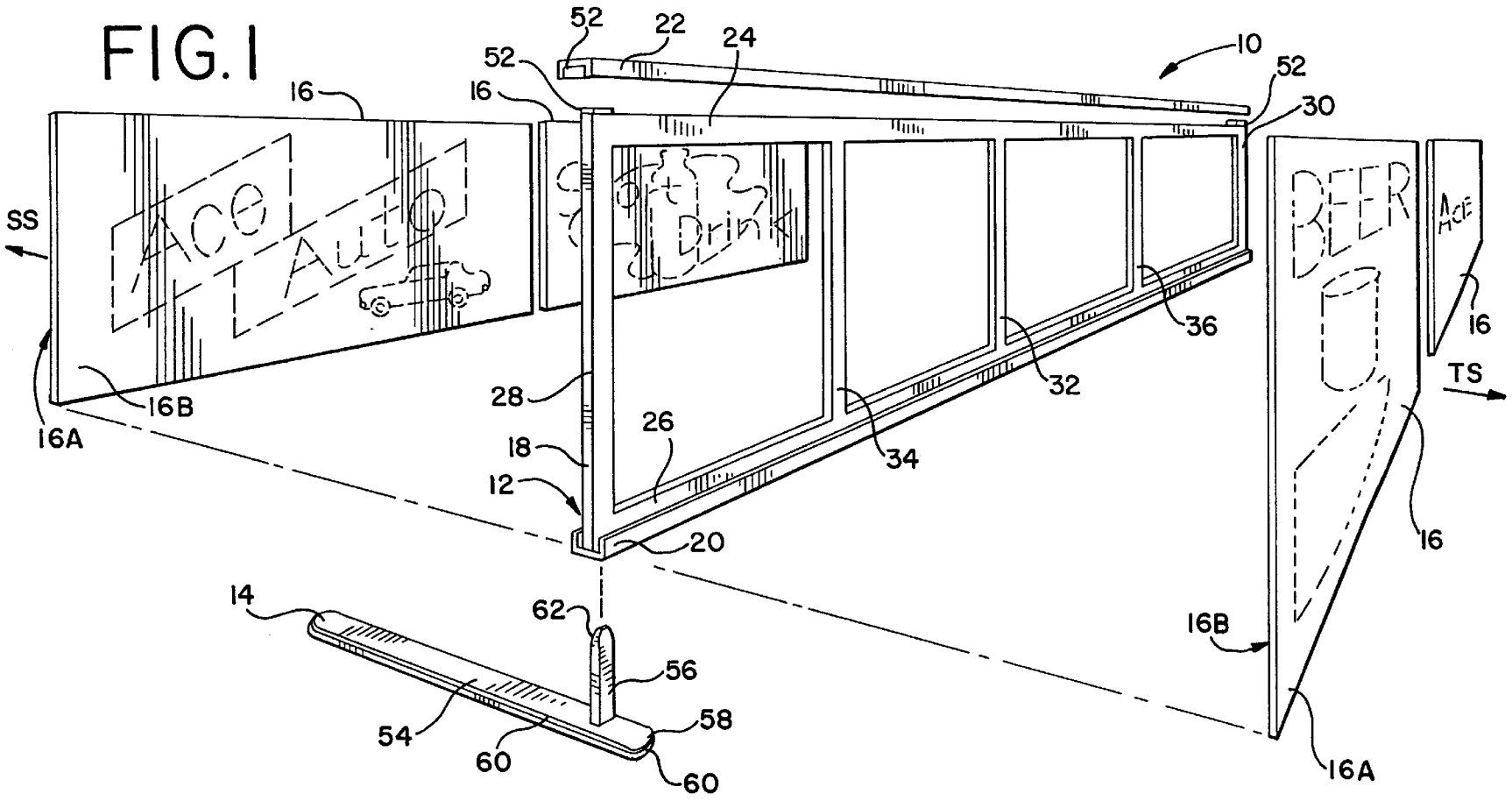
FIG. 1 is an exploded perspective view of the stadium signage system of the present invention showing a frame assembly, mounting stand and adpanels.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Referring to the drawings, FIG. 1 illustrates an exploded view of a stadium signage system generally designated by the reference numeral 10. The stadium signage system 10 generally includes a frame assembly 12, a mounting stand 14 and promotional/informational signage, or adpanels 16.

The frame assembly 12 generally includes a support frame 18 and receiving members, namely, a first channel 20 and a second channel 22. The support frame 18 has a top rail 24 and bottom rail 26. First and second vertical cross-members 28,30 are welded to the ends of the rails 24,26 to form a rectangular support frame 18. The support frame 18 preferably has a center vertical cross-member 32 and a pair of intermediate cross-members 34,36 that divide the support frame 18 into four sections. In a preferred embodiment, the support frame 18 is twenty feet long and approximately three feet high. The dimensions of the support frame 18 could vary as well as the number of cross-members. The support frame 18 is made from lightweight aluminum and weighs approximately 120 pounds. Obviously, other materials could be used for the support frame 18, and means other than welding could be used to construct the support frame 18.

Figure 3:
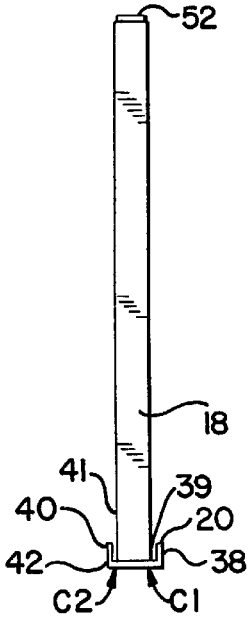
FIG. 3 is an end elevational view of the frame assembly.

As shown in FIG. 3, the first channel 20 is generally U-shaped having a first upward member 38 and a second upward member 40 connected by an intermediate section 42. The intermediate section 42 is connected to an underside of the bottom rail 26 of the support frame 12, typically by welding. In this configuration, the first upward member 38 confronts, in spaced relation, a first side 39 of the bottom rail 26 and the second upward member 40 confronts, in spaced relation, a second side 41 of the bottom rail 26. A first space, recess, or a clearance "C1," is thus defined between the first upward member 38 and the first side 39 of the bottom rail 26. Similarly, a second space, or a clearance "C2," is thus defined between the second upward member 40 and the second side 41 of the bottom rail 26. The first and second spaces C1 and C2 will receive or accommodate the adpanels 16 as described below. Preferably, the first channel 20 extends the length of the support frame 18, although the first channel 20 could be comprised of a plurality of smaller channels spaced accordingly to hold the adpanels 16. In addition, the first channel 20 and bottom rail 26 have corresponding U-shaped openings 44 (FIG. 4) that will receive the mounting stands 14 into the frame assembly 12 as described below. In the preferred embodiment, the first channel 20 and support frame 18 are separate members. The support frame 18, however, could be designed to integrally carry receiving members such as the first channel 20 or other types of receiving members to receive the adpanels 16.

Figure 7:
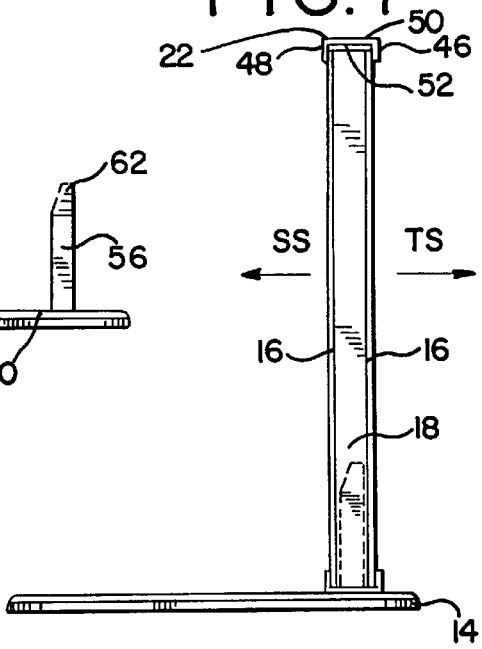
FIG. 7 is a side elevational view of the stadium signage system shown in FIG. 1 using two sets of adpanels, one set on each side of the frame assembly.

As shown in FIG. 7, the second channel 22 is similarly shaped to the first channel 20 and has a first downward member 46 and second downward member 48 connected by an intermediate section 50. The second channel 22 is releasably secured to the support frame 18. Specifically, the intermediate section 50 connects to the top rail 24 with cooperating hook and loop fasteners 52 positioned along an upperside of the top rail 24 and underside of the second channel 22. It is understood that the second channel 22 could be secured to the top rail 24 by other means. The second channel 22 could be hingedly connected if desired. With the second channel 22, a space or clearance, similar to the clearances C1 and C2 between the upper members 38,40 and the bottom rail 26, is also maintained between the downward members 46,48 and the top rail 24. In a preferred embodiment, the second channel 22 is formed from two separate channels placed adjacent one another on end along the top rail 24. A single extruded channel, however, could also be used.

The first and second channels 20,22 are preferably U-shaped to provide clearances on both sides of the frame assembly 12 for receiving the adpanels 16. This configuration accommodates respective adpanels 16 on both sides of the frame assembly 12. It is understood, however, that the channels 20,22 could be designed to accommodate adpanels on only one side of the frame assembly 12. For example, an angle iron, or L-bracket, could be attached to the bottom rail 26 of the support frame 18 to accommodate adpanels 16 on only one side of the frame assembly 12. Also, a pair of L-brackets could be used instead of the single U-shaped channel to accommodate adpanels 16 on both sides of the frame assembly 12.

Figure 2:
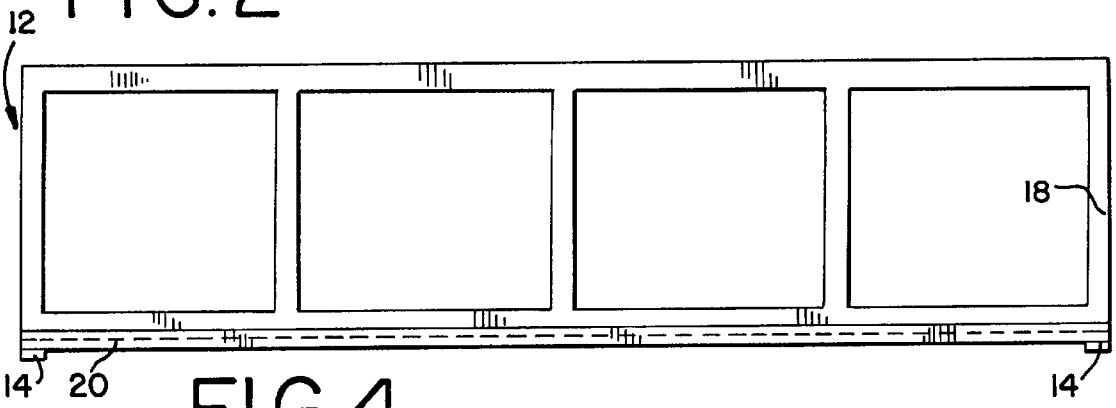
FIG. 2 is a front elevational view of the frame assembly of FIG. 1 mounted in a pair of mounting stands.
Figure 4:
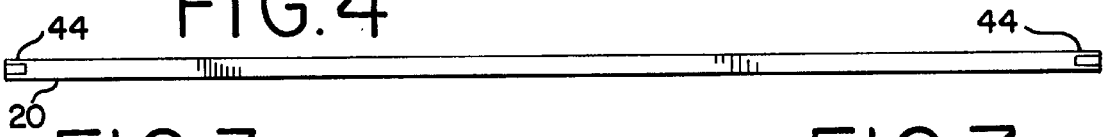
FIG. 4 is a plan view of an underside of the frame assembly showing openings in the frame assembly.
Figure 5:
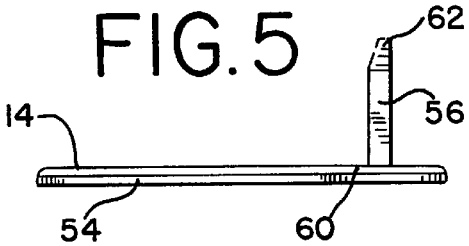
FIG. 5 is a side elevational of the mounting stand shown in FIG. 1.

As shown in FIGS. 1, 6 and 7, the frame assembly 12 is supported in an upright position by a mounting stand 14. A single mounting stand 14 could be used to support the frame assembly 12 such as at the center of the frame assembly 12. An opening, similar to openings 44 in FIG. 4 could be provided proximate to a center of the frame assembly 12. In a preferred embodiment, however, a pair of mounting stands 14 are used, one at each end of the frame assembly 12. The frame assembly 12 has the openings 44 to accommodate the mounting stands 14 (FIGS. 1, 2 and 4). As shown in FIGS. 1 and 5, the mounting stand 14 is L-shaped having an elongated base 54 and a post 56 extending vertically from the base 54. A front of the elongated base has a rounded end 58 (FIG. 1) to eliminate sharp corners. Edges 60 of the elongated base are beveled to further eliminate any sharp corners. The post 56 has a cross-section only slightly smaller than the openings 44 in the underside of the frame assembly 12. To aid in inserting the post 56 into the openings 44, an end 62 of the post 56 is tapered. The mounting stand 14 is preferably made of steel and is weighted to add stability. In a preferred embodiment, the mounting stand 14 weighs approximately twenty-two pounds. The elongated base 54 is approximately three feet long and the post 56 is approximately a foot high. These dimensions could vary. The combination of the elongated base 54 and weight of the mounting stand 14 adds stability to the system 10. The mounting stand 14 could be integrally connected to the support frame 18 if desired. Preferably, however, the mounting stand 14 is separate from the support frame 18.

Figure 9:
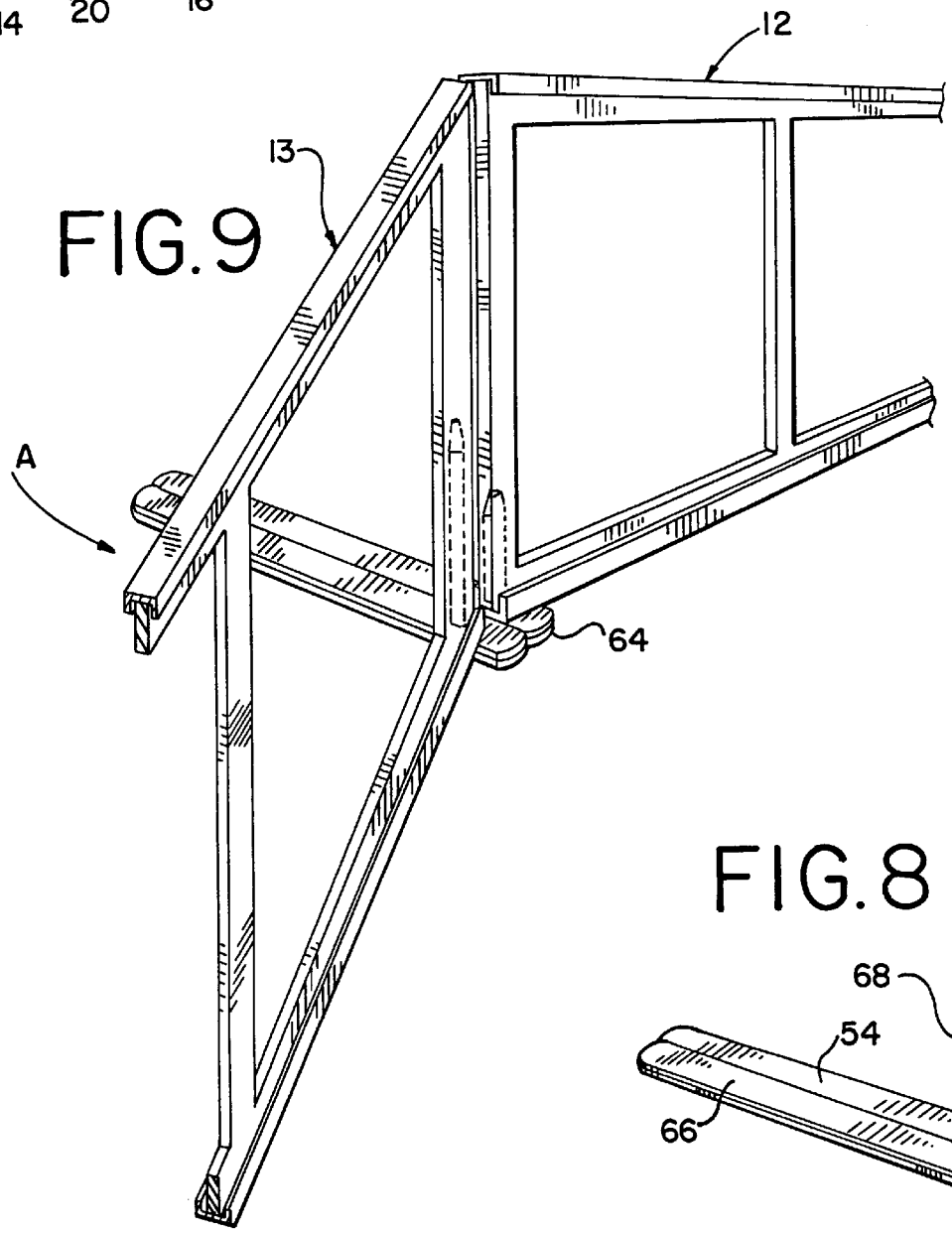
FIG. 9 is a partial perspective view of first frame assembly and a second frame assembly using the modified mounting stand shown in FIG. 8 for one frame assembly to function as a gate; and, FIG. 10 is a schematic plan view of a plurality of signage systems placed adjacent to one another on end around a periphery of a playing field and in front of a stadium grandstand.
Figure 8:
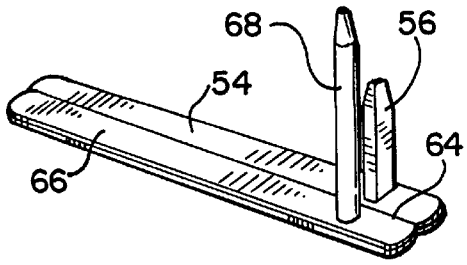
FIG. 8 is a perspective view of a modified mounting stand used to support a frame assembly for use as a gate.

As shown in FIGS. 8 and 9, a modified mounting stand 64 can also be used with the system 10 to provide for a gate described below. The modified mounting stand 64 has an additional elongated base 66 attached to the first elongated base 54. A pole 68, approximately two feet long, is connected to the additional elongated base 66 to rotatably support an additional frame assembly 12. The pole 68 is longer than the post 56 for better rotational support. The modified mounting stand 64 is weighted to add stability. In a preferred embodiment, the modified mounting stand 64 weighs approximately fifty pounds.

The adpanels 16 used in the system 10 are made from an aluminum/polycarbonate composite called Dibond and are commercially available. A layer of polycarbonate material is sandwiched between two layers of aluminum. The adpanel 16 can range in thickness and be about four millimeters thick but is preferably two millimeters thick. Because of their composite structure, the adpanels 16 are extremely rigid, strong and, thus, durable. Advertising and promotional signs, or other messages, are printed on, for example, decal material and then laminated to the adpanels 16. The aluminum provides a good surface for lamination. The signs can be laminated on both sides 16*a* and 16*b* of the adpanels 16. The sides 16*a* face away from the frame assembly 12 and the sides 16*b* face towards the frame assembly. As further described below, this allows for a single set of adpanels to display signage on both sides of the frame assembly 12. In addition, by using decal material that readily peels off the adpanel 16 when heated, such as by a conventional hot air dryer, the advertising signs can easily be changed. The durability of the adpanels 16 coupled with the interchangeability of the actual signs makes the adpanels 16 reusable almost indefinitely. In addition, the composite material minimizes any thermal expansion or contraction of the adpanels 16 due to fluctuations in temperature. This minimizes any ripples in the actual sign material. Although ripples may seem small and negligible, they are readily noticeable to spectators viewing the signs from a distance and, therefore, very undesirable.

Figure 6A:
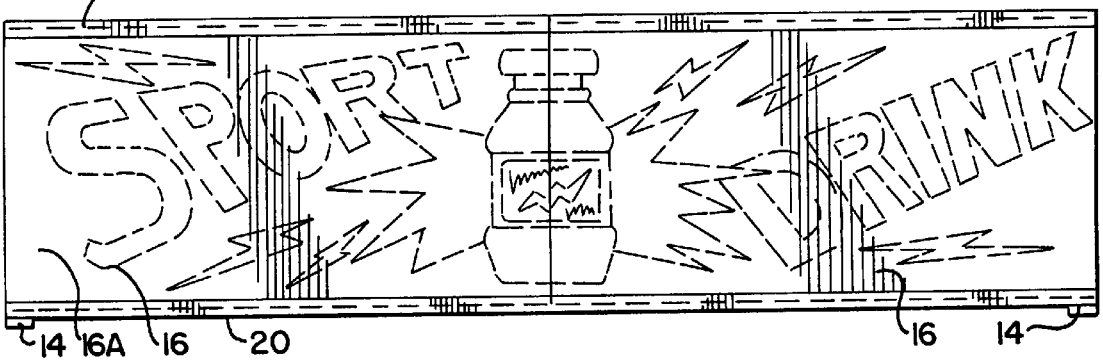
FIG. 6*a* is front elevational view of the stadium signage system which uses a single set of adpanels on one side of the frame assembly.
Figure 6B:
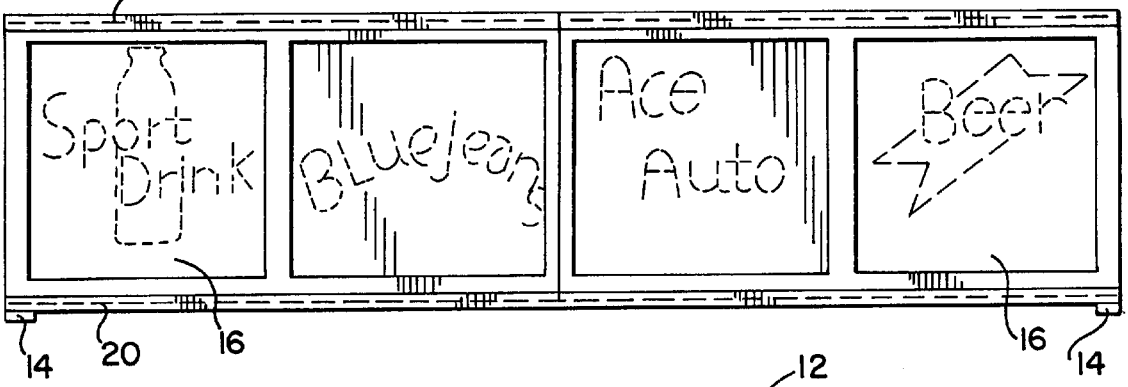
FIG. 6*b* is a rear elevational view of the stadium signage system shown in FIG. 6*a;*

As shown in FIG. 1, two 10 foot long adpanels 16 are typically used on one side of the frame assembly 12 and two 10 foot long adpanels 16 are used on the other side of the frame assembly 12. As shown in FIGS. 1, 6*a* and 6*b*, each 10 foot adpanel 16 can contain multiple advertisements or messages. In addition, the two adpanels can combine to form a single advertisement or message. FIG. 6*a* shows two adpanels 16 combining to form a single advertisement. FIG. 6*b* shows the adpanels 16 having multiple advertisements or messages. The height of the adpanels 16 is typically three feet, although this height could vary with the height of the support frame 18. In addition, the adpanels 16 could extend above the height of the support frame 18.

To set-up a single stadium signage system 10, a pair of mounting stands 14 are spaced adjacent a stadium playing field approximately twenty feet apart. The rounded ends 58 of the mounting stands 14 are positioned closest to the field and the elongated portion of the base 54 is projects towards the stadium grandstand. The frame assembly 12 is then lifted and the mounting stand posts 56 are inserted into the openings 44 of the frame assembly 12 (FIG. 2). The cross-section of the post 54 is only slightly smaller than the openings 44. These close tolerances minimize any wobbling of the frame assembly in a vertical plane. Notwithstanding the close tolerances, the tapered ends 62 of the posts 56 allow for quick insertion. In addition, the posts 56 are approximately a foot high, which provides adequate stability while easily allowing the installer to lift the frame assembly 12 over the posts 56 for insertion. The posts 56 could also be slid in from the side of the bottom rail 26 and then into the frame assembly 12.

As shown in FIGS. 6 and 7, a pair of adpanels 16 are then mounted on the frame assembly 12 by inserting a bottom edge of each adpanel 16 into the clearance C1 between the first upward member 38 of the first channel 20 and the bottom rail 26 of the support frame 18. These adpanels 16 face the playing field, or the television side "TS." Similarly, a second pair of adpanels 16 (FIGS. 1 and 7) are mounted on the other side of the frame assembly 12 by inserting a bottom edge of each adpanel 16 into the clearance C2 between the second upward member 40 of the first channel 20 and bottom rail 26 of the support frame 20. These adpanels 16 face the stadium grandstand, or the spectator side "SS." As shown in FIGS. 1, 6 and 7, the second channel 22 is then mounted on the top rail 24 of the support frame 18 wherein top edges of the adpanels 16 fit between the top rail 24 and the downward members 46,48 of the second channel 22. The hook and loop fasteners 52 secure the second channel 22 to the top rail 24 and, therefore, the second channel 22 retains the adpanels 16 against the top rail 24. As can be appreciated, the stadium signage system 10 can be set-up in a very short time. The adpanels 16 are easily inserted into the frame assembly 12. With the use of the hook and loop fasteners 52, the second channel 22 is quickly installed as well. The hook and loop fasteners 52 are shown at the ends of the top rail 24. They could extend further along the top rail 24 if desired. It is appreciated that the system 10 could be used without the second channel 22. The second channel 22 is preferred, however, to better secure the adpanels 16 to the frame assembly 12.

As shown in FIGS. 3 and 7, the clearances C1, C2 and the clearances between the second channel 22 and top rail 24 are designed to correspond to the thickness of the adpanels 16, approximately two millimeters. Accordingly, the adpanels 16 fit snugly between the channels 20,22 and the support frame 18. Because of the close tolerances, the adpanels 16 are very stable and do not greatly shift or wobble within the frame assembly 12. If desired, different size channels could be used to accommodate thicker or thinner adpanels 16. In addition, hook and loop fasteners 52 could be placed on an outer edge of the downward members 46,48 if it is desired to hang replacement adpanels over existing adpanels installed in the frame assembly 12.

Figure 10:
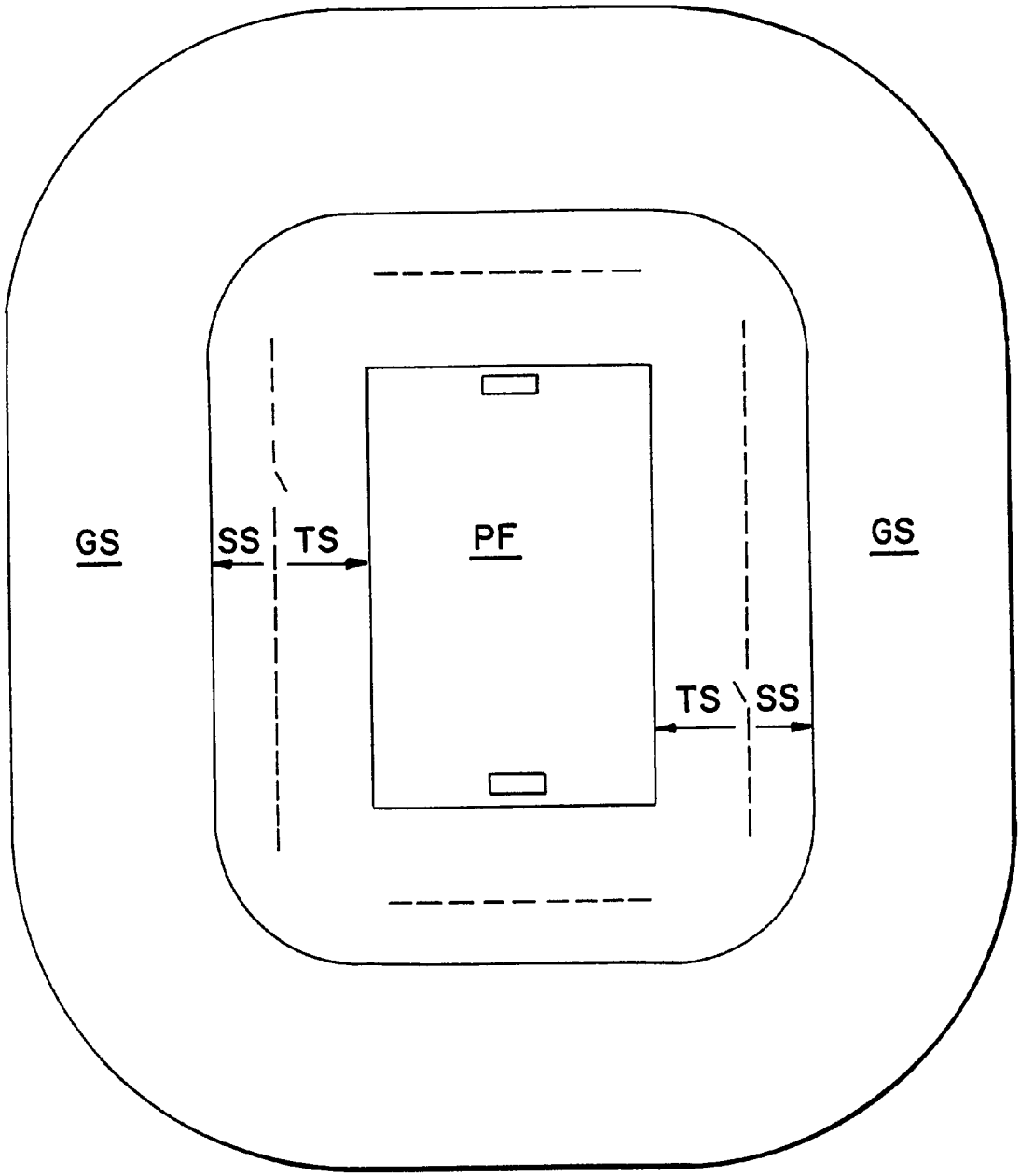

Typically, this process is repeated for a plurality of stadium signage systems 10. As shown in FIG. 10, the systems 10 are then placed adjacent on another, on end, around a full periphery of the playing field (PF) and in front of a stadium grandstand (GS). Either seventeen or nineteen systems 10 are generally used on each side of the playing field and nine systems are generally used on each end of the playing field. If desired, special curved frame assemblies and adpanels (not shown) can be set up for the four corners of the playing field similar to the curved corners of the boards of an ice hockey arena. With the systems around the playing field, television cameras inherently view the adpanels 16 while covering the action of the game. Spectators sitting in the grandstands see the adpanels 16 directing facing the grandstand (SS) and also see the adpanels 16 facing the playing field on the opposite sides of the field (TS). The spectators can also see the adpanels 16 at the ends of the field. If the stadium only has a grandstand on one side of the playing field, the signage systems 10 may not include adpanels 16 on both sides. For instance, signage systems 10 on the side of the playing field without a grandstand may not have adpanels 16 facing the spectator side SS. If there is no television coverage from this side of the field, the signage systems 10 closest to the grandstand may not have adpanels 16 facing the playing field. Similar configurations could also apply if television coverage is only taking place from one side of the playing field. In addition, with the plurality of systems 10 set-up as shown in FIG. 10, the systems 10 also prevent unauthorized people from obtaining easy access to the playing field.

The channels 20,22 receive the edges of the adpanels 16 allowing for quick insertion of the adpanels 16 into the frame assembly 12 and, thus, are preferred. It is also preferred that the channels 20,22 extend the entire length of the support frame 18. This configuration gives greater support, protects the edges of the adpanels 16 and is more visually appealing. However, other receiving members could also be used to hold, retain, receive, or otherwise support the adpanels 16 on the support frame 18. For example, as discussed, a plurality of smaller channels could be used along the support frame 18 at the ends of the adpanels 16. Hinged fingers that grip an edge of the adpanel 16 could also be used. Clamps can also be used. Channels 20, 22 are, nevertheless, preferred. It is further understood that receiving members could be placed at the top of the support frame 18 and, thus, suspend the adpanels 16 from the support frame 18. It is preferred, however, to use the first channel 20 to receive and support the adpanels 16 along the bottom rail 26 of the support frame 18.

Because the signage systems 10 extend around the playing field, it is desirable to provide direct access to the playing field without requiring players or stadium personnel to jump over the systems 10 or completely remove a signage system 10. As previously discussed, the modified mounting stand 64 is provided to convert a frame assembly 12 into a gate. As shown in FIGS. 8 and 9, the modified mounting stand 64 is used at one end of a first frame assembly 12. A second frame assembly 13 is then inserted over the pole 68 through an opening 44. The pole 68 rotatably supports the second frame assembly 13. To allow players direct access to and from the field, for example, a single stadium official can lift an opposite end of the second frame assembly 13 and rotate it in direction of arrow A to provide an opening through the signage systems 10 (FIGS. 9 and 10). The pole 68 is spaced approximately an inch from the post 68, and the opening 44 in the second frame assembly 13 is slightly larger than the other openings 44. This allows for the second frame assembly 13 to slightly slide laterally when rotating the second frame assembly 13 and prevents interference with the first frame assembly 12. After closing the gate, the second frame assembly 13 rests adjacent to the next signage system 10. The weight of the frame assembly 13 keeps the gate closed although a latch mechanism could be used if desired. Typically, three modified mounting stands are used to provide for three gates around the field. In addition, the pole 68 can be positioned on either side of the post 56 to provide for left and right opening gates. The gates can be rotated either way, towards the playing field or away from the playing field. For clarity, FIG. 9 has been shown without the adpanels 16 installed. It is understood that the second frame assembly 13 operates as a gate with the adpanels 16 installed.

To transport the plurality of signage systems 10 from stadium to stadium, a trailer (not shown) is equipped with a number of stationary racks having a plurality of posts similar to posts 56. The frame assemblies are then stored upright, side-by-side, on the racks in the trailer. All of the mounting stands 14 are then stacked in another portion of the trailer. The trailer can also have a table that flips up to allow for advertisement decals to be applied to blank adpanels. When taking the frame assemblies 12 off of the trailer, a few frame assemblies 12 are loaded onto carts with pneumatic tires. The carts transport the frame assemblies 12 and mounting stands 14 to the appropriate area of the field for set-up. To facilitate a quicker set-up, the adpanels 16 can be pre-inserted in the frame assemblies 12 and the frame assemblies 12 marked with the respective advertisement. Because of the novel construction of the systems 10, only eight man-hours are typically required to set-up signage systems 10 around an entire stadium playing field. In addition, storage racks, similar to the trailer stationary racks, can be provided to store the frame assemblies 12 at the stadium. The storage racks can be located away from the playing field to store frame assemblies 12 until they are to be set-up. The storage racks accommodate ten frame assemblies 12 side-by-side. A tarp is provided to cover the stored frame assemblies 12.

It is also contemplated that the system 10 can function as a portable barrier to be set-up where needed. For example, the system 10 can function as a portable fence for sporting events. The system 10 could also be used as a barrier for crowd control. The system 10 could be used in these applications with blank adpanels 16 or even without the adpanels 16. It would be preferred, however, to use the adpanels 16, with signage thereon, in the system 10 because the adpanels 16 mounted in the frame assembly 12 would provide a more effective barrier. In addition, advertising can be displayed simultaneously while, for example, controlling movement of event spectators.

The above-described structure provides a number of advantages over previous signage systems. There are few parts to the system and no bolts or screws are needed. Most of the rigid connections are welded. The channels 20,22 used on the frame assembly 12 allow for easy insertion and containment of the adpanels 16 against the support frame 18. The channels 20,22 allow for fast set-up and tear down of the systems 10 and also for fast adpanel replacement such as when changing an advertisement on a particular signage system 10. This is especially important when there are two games on the same day and advertisements must be placed in different areas of the field or replaced all together for the second game.

Once inserted into the first channel 20 and after the second channel 22 is installed, the adpanels 16 are securely held against the support frame 18. The adpanels 16 are very stable and cannot shift within the support frame 18. Furthermore, the channels 20,22 allow for adpanels 16 to be placed on both sides of the support frame 18. Advertising can then face both the playing field, or television side TS, and the grandstand, or spectator side SS (FIGS. 1 and 7). Previous signage systems only provided for advertisements facing the television side TS. In addition, as the adpanels 16 can contain signs on both sides 16*a* and 16*b*, advertising can face the television side and spectator side using a single set of adpanels 16.

The structure of the mounting stands 14 help provide a system 10 that is very rigid and stable. First, the vertical post 56 of the mounting stand 14 fits into the opening 44 of the frame assembly 12 in a close-fitting manner preventing the frame assembly 12 from wobbling. Second, the elongated base 54 and post 56 provide stability by preventing the frame assembly 12 from tipping. The weight of the mounting stand adds further stability. Because of the large clearances between the plywood signs and the support stands in the previous signage systems, the signs tended to wobble excessively. Also, the weight of the mounting stands 14 eliminates the need for sandbags, which are considered unsightly. Finally, the rounded and beveled ends 58,60 of the mounting stands 14 eliminates sharp corners that could be dangerous if a player, for example, slid into the mounting stands 14.

The construction of the adpanels 16 also provide a number of advantages. Because the adpanels 16 are a polycarbonate/aluminum composite, they are extremely rigid and strong. They do not warp like the previous plywood signs. In addition, the aluminum outer surface provides a good surface for the lamination of advertisements. As discussed, ripples in the adpanels 16 are minimized, thus, reducing any glare from the sun. It is also very easy to replace adpanels 16 as opposed to the previous signage systems where the advertisements were painted directly onto the plywood panels. The adpanels 16 of the present system 10 can be reused almost indefinitely.

In addition, the system 10 provides a number of options and, thus, considerable flexibility in displaying different signs and changing signs, for example, from one game to the next. As previously discussed, the signage system 10 allows for one set of adpanels 16 to face the television side TS and a second set of adpanels 16 to face the spectator side SS (FIGS. 1 and 7). Because each adpanel 16 could have a sign printed on each of its own sides 16*a* and 16*b*, four different options for displaying advertising are provided with a single system 10.

In addition, advertising could face both the television side TS and the spectator side SS using only a single set of adpanels 16. FIGS. 6*a* and 6*b* show this configuration. As shown in FIG. 6*a*, the adpanels 16 have a sign on one side 16*a* facing the television side TS. As shown in FIG. 6*b*, an opposite side 16*b* of the adpanels 16 have smaller signs thereon that face the spectator side SS. Because using only one set of adpanels 16 exposes the vertical cross-members 28–36 of the support frame 18, the smaller signs are sized to fit within the sections of the support frame 18 defined by the vertical cross-members 28–36. It is understood that the adpanels 16 could be reversed if desired so that the smaller signs would face the television side TS.

In another example, the adpanels 16 could have an advertising sign on one side and be covered with a "blank" white sign on the other side in case advertising space was not sold. The advertising sign would face the playing field while the blank white sign would face the support frame 18. This configuration could also be reversed.

Adpanels 16 having a blank side are also helpful when there are two games in a single day and, for example, the sign placement must change between games and advertising space on the signage systems 10 has not been completely sold for the second game. For instance, during a first game, a signage system 10 may have a first set of adpanels 16 having an advertising sign facing the television side TS. The other side of the first set of adpanels 16 are blank. The blank sides, however, may be covered by a second set of adpanels 16 having signs facing the spectator side SS. The second game may require the second set of adpanels 16 facing the spectator side SS to now face the television side TS. If advertising space was not sold facing the spectator side SS for the second game, the first and second set of adpanels 16 could be easily and quickly switched. Thus, the second set of adpanels 16 would be positioned facing the television side TS and the first set of adpanels 16 would be positioned on the other side of the frame assembly 12 with the blank signs facing the spectator side SS. In such instances where advertising space has not been specifically sold, adpanels 16 having signs of one of the game's "major" sponsors, or of a general nature, could be used rather than using blank signs.

Thus, because the signage systems 10 can accommodate two sets of adpanels 16 facing the television side TS and the spectator side SS and the adpanels 16 themselves can contain signs on both sides 16*a* and 16*b*, the signage systems 10 offer great flexibility in displaying signage.

The modified mounting stand 64 also provides advantages. Primarily, it allows for the frame assembly 13 to function as a gate to provide direct and easy access to and from the playing field. With the gate, players, officials and stadium personnel do not have to move an entire signage system to allow for access to and from the playing field. Instead, the modified mounting stand 64 allows a single person to rotate the frame assembly 13.

In all, the system 10 is portable and can be set-up wherever signage is desired, or a portable barrier is needed. Furthermore, the system 10 is easily and quickly set-up and disassembled. The prior art signage system previously described requires substantially more man-hours to set-up than the signage system 10 of the present invention. The present system 10 also has superior storage and transporting systems. The system 10 is also aesthetically more pleasing to spectators.

While particular embodiments of the invention have been shown and described, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

What I claim is:

1. A signage system for displaying signage at events, the signage system comprising:

a mounting stand;

a support frame supported in an upright position by the mounting stand, the support frame having a rail;

a receiving member connected to the support frame, the receiving member comprising a bottom channel extending along the rail, the bottom channel having a first upward member spaced from the rail to define a first space;

a first adpanel having a sign thereon, the adpanel inserted into the first space wherein the adpanel is supported adjacent the support frame; and, a top channel releasably secured to the support frame by hook and loop fasteners, the channel having a first downward member and a second downward member wherein the support frame is positioned between the downward members, one of the downward members retaining an upper portion of the adpanel against the support frame.

2. The signage system of claim 1 wherein the first upward member is spaced from a first side of the rail to define the first space.

3. The signage system of claim 2 wherein the bottom channel has a second upward member spaced from a second side of the rail to define a second space, and further including a second adpanel having a sign thereon, the second adpanel being inserted into the second space wherein the second adpanel is supported adjacent an opposite side of the support frame with the sign on the second adpanel facing away from the support frame.

4. The signage system of claim 3 wherein the second downward member retains the second adpanel against an opposite side of the support frame.

5. The signage system of claim 3 wherein the support frame is adapted to be positioned between a stadium grandstand and a playing field wherein the first adpanel faces the playing field and the second adpanel faces the grandstand.

6. The signage system of claim 1 wherein a plurality of stadium signage systems adapted to be are positioned adjacent one another on end around a playing field.

7. The signage system of claim 1 wherein the mounting stand comprises a modified mounting stand, the modified mounting stand connecting a second support frame of a second signage system to the signage system, the modified mounting stand rotatably supporting the second support frame allowing the second support frame to function as a gate.

8. The signage system of claim 1 wherein the adpanel is comprised of a plurality of adpanels.

9. The signage system of claim 1 wherein the adpanel has a sign on each side.

10. The signage system of claim 1 wherein the mounting stand has an elongated base and a post extending from the elongated base and having a tapered end, the post being inserted into an opening in an underside of the support frame in tight-fitting relation to support the support frame in the upright position.

11. The signage system of claim 1 wherein the mounting stand is weighted to add stability to the stadium signage system.

12. The signage system of claim 10 wherein the modified mounting stand has an elongated base, a post extending from the elongated base and a pole extending from the base and positioned adjacent to the post, the pole being inserted into an opening in an underside of the second support frame to rotatably support the second support frame.

13. The signage system of claim 1 wherein the mounting stand is comprised of a pair of mounting stands, one of said pair of mounting stands positioned at each end of the support frame to support the support frame in the upright position.

14. A stadium signage system for displaying signage at events, the stadium signage system comprising:

a mounting stand;

a support frame supported in an upright position by the mounting stand, the support frame having a bottom rail and a top rail;

a first channel extending along the bottom rail, the first channel having a first upward member wherein a first space is defined between the first upward member and a first side of the bottom rail;

an adpanel having a sign thereon, the adpanel inserted into the first space wherein the adpanel is supported adjacent the support frame; and, a second channel releasably secured to the top rail, the second channel having a first downward member and a second downward member wherein the top rail is positioned between the downward members, one of the downward members retaining an upper portion of the adpanel against the top rail.

15. The signage system of claim 14 wherein the first channel has a second upward member wherein a second space is defined between the second upward member and a second side of the bottom rail, and further including a second adpanel having a sign thereon, the second adpanel being inserted into the second space wherein the second adpanel is supported adjacent an opposite side of the support frame.

16. The signage system of claim 15 wherein the second downward member retains the second adpanel against an opposite side of the top rail.

17. The signage system of claim 15 wherein the support frame is adapted to be positioned between a stadium grandstand and a playing field wherein the the first adpanel faces the playing field and the second adpanel faces the grandstand.

18. The signage system of claim 17 wherein the adpanels have signs on both of their sides wherein each adpanel, on each side of the support frame, can be positioned to face away from the support frame and can be repositioned to face towards the support frame.

19. A method of using a stadium signage system for displaying signage at a stadium event, the stadium having a playing field and a grandstand, the method comprising the steps of:

providing a mounting stand and positioning the mounting stand between the playing field and the grandstand;

providing a support frame having a top rail and a bottom rail, the support frame further having a first channel extending along the bottom rail, the first channel having a first upward member wherein a first space is defined between the first upward member and a first side of the bottom rail;

mounting the support frame on the mounting stand in an upright position wherein one side of the support frame faces the playing field and an opposite side of the support frame faces the grandstand;

providing an adpanel having a sign thereon; and, inserting the adpanel into the first space wherein the sign faces the playing field for viewing by spectators; and, providing a second channel having a first downward member and a second downward member and releasably securing the second channel on the top rail of the support frame wherein the top rail is positioned between the downward members and wherein the first downward member retains the adpanel against the top rail.

20. The method of claim 19 wherein the first channel has a second upward member wherein a second space is defined between the second upward member and a second side of the bottom rail, and further providing a second adpanel having a sign thereon, inserting the second adpanel into the second space wherein the second adpanel is supported adjacent an opposite side of the support frame with the sign on the second adpanel facing the grandstand for viewing by spectators.

21. The method of claim 20 wherein the second downward member retains the second adpanel against an opposite side of the top rail.

22. A stadium signage system for displaying promotional and informational signs at soccer games played in a stadium having a grandstand facing a playing field:

a first mounting stand having a post;

a second mounting stand having a post, the second mounting stand being spaced from the first mounting stand;

a support frame having a pair of spaced openings that receive the mounting stand posts to support the support frame in an upright position, the support frame further having a bottom rail and a top rail, the support frame positioned between the grandstand and the playing field;

a first channel connected to the bottom rail and having a first upward member spaced from a first side of the bottom rail to define a first space, the first channel further having a second upward member spaced from a second side of the bottom rail to define a second space;

a first adpanel inserted into the first space, the first adpanel having a sign thereon that faces the playing field;

a second adpanel inserted into the second space, the second adpanel having a sign thereon that faces the grandstand; and, a second channel having a first downward member and a second downward member, the second channel releasably secured to the top rail wherein the first downward member retains the first adpanel against a first side of the top rail and the second downward member retains the second adpanel against a second side of the top rail.

23. A signage system for displaying signage at events, the signage system comprising:

a modified mounting stand;

a support frame supported in an upright position by the mounting stand;

a receiving member connected to the support frame, the receiving member having a first space defined therein; and, an adpanel having a sign thereon, the adpanel inserted into the first space wherein the adpanel is supported adjacent the support frame;

the modified mounting stand connecting a support frame of a second signage system to the signage system, the modified mounting stand rotatably supporting the second support frame allowing the second support frame to function as a gate.

24. A signage system for displaying signage at events, the signage system comprising:

a pair of mounting stands, each mounting stand having a post;

a support frame wherein one of said mounting stands is positioned at each end of the support frame to support the support frame in an upright position, the support frame having a pair of spaced openings that receive the mounting stand posts;

a receiving member connected to the support frame, the receiving member having a first space defined therein;

an adpanel having a sign thereon, the adpanel inserted into the first space wherein the adpanel is supported adjacent the support frame; and, a top channel releasably secured to the support frame, the channel having a downward member that retains an upper portion of the adpanel against the support frame.

25. A signage system for displaying signage at events, the signage system comprising:

a mounting stand;

a support frame supported in an upright position by the mounting stand, the support frame having a bottom rail and a top rail;

a first channel extending along the bottom rail, the first channel having a first upward member wherein a first space is defined between the first upward member and a first side of the bottom rail, the first channel further having a second upward member wherein a second space is defined between the second upward member and a second side of the bottom rail;

an adpanel having a sign thereon, the adpanel inserted into the first space wherein the adpanel is supported adjacent the support frame;

a second adpanel having a sign thereon, the second adpanel being inserted into the second space wherein the second adpanel is supported adjacent an opposite side of the support frame; and, a second channel releasably secured to the top rail, the second channel having a first downward member that retains an upper portion of the adpanel against the top rail, the second channel having a second downward member that retains an upper portion of the second adpanel against an opposite side of the top rail.

* * * * *

UNITED STATES PATENT AND TRADEMARK OFFICE

CERTIFICATE OF CORRECTION

PATENT NO. : 5,941,002

DATED : August 24, 1999

INVENTOR(S) : Clifford R. Rusin

It is certified that error appears in the above-identified patent and that said Letters Patent is hereby corrected as shown below:

Column 11, line 41, after "systems" delete "adapted to be are" and insert -- are adapted to be --.

Signed and Sealed this

Thirtieth Day of January, 2001

*Attest:*

*Attesting Officer*

Q. TODD DICKINSON

*Director of Patents and Trademarks*